United States Patent [19]

Kanazawa et al.

[11] 4,434,892

[45] Mar. 6, 1984

[54] HOLDING DEVICE FOR NESTED PIPES

[75] Inventors: Tatsuo Kanazawa, Kamagaya; Tsuneo Suyama, Narita, both of Japan

[73] Assignee: Kubota, Ltd., Osaka, Japan

[21] Appl. No.: 392,212

[22] Filed: Jun. 25, 1982

[30] Foreign Application Priority Data

Jul. 30, 1981 [JP] Japan ..... 56-120387

[51] Int. Cl.[3] ..... B65D 85/20

[52] U.S. Cl. ..... 206/446; 206/443; 206/821

[58] Field of Search ..... 206/443, 446, 821; 138/148

[56] References Cited

U.S. PATENT DOCUMENTS

| | | | |
|---|---|---|---|
| 1,975,269 | 10/1934 | Gray | 138/148 |
| 4,250,928 | 2/1981 | Nishikawa | 138/113 |
| 4,253,792 | 3/1981 | Nishikawa | 414/589 |

*Primary Examiner*—William T. Dixson, Jr.
*Assistant Examiner*—Brenda J. Ehrhardt
*Attorney, Agent, or Firm*—Joseph W. Farley

[57] ABSTRACT

A device for holding nested pipes which comprises an abutting member adapted to bear against the socket ends of all the pipes, and radial-axial retainer means removably mountable on the abutting member and having an engaging projection fittingly engageable in an annular groove of the diametrically larger of two adjacent pipes included in the pipes and engaging stepped means engageable with an annular shoulder of the diametrically smaller of the two pipes. The device is composed of a small number of parts, is therefore inexpensive to make and easy to install on the pipes and reliably holds the pipes even when the two adjacent pipes differ greatly in diameter. Such devices are usable as units to provide a compact and lightweight overall holding device since a mount frame which would add to the weight of the device is not always needed.

11 Claims, 4 Drawing Figures

HOLDING DEVICE FOR NESTED PIPES

The present invention relates to a device for holding nested pipes to one another each at its socket end.

When nested, pipes of different diameters can be transported with effective use of the loading space. This method of transport is also very advantageous because diametrically small pipes function to reinforce diametrically larger pipes against deformation.

When thus nested for transport, the pipes must of course be held to one another. A holding device is known which is used for this purpose and which comprises a mount frame, a plurality of abutting members extending radially from the mount frame and adapted to bear against the socket ends of nested pipes, and engaging pawls mounted on the abutting members and fittingly engageable in annular inner grooves at the socket ends of the pipes from inside radially thereof, some of the pawls being removable from the abutting members and the others fixed thereto. Since the engaging pawls are provided in a large number and must be fastened accurately in position, the device is cumbersome to make and assemble, whereas the pawls are likely to be mispositioned because they are many, failing to hold the nested pipes properly. Moreover the device is costly. Further because the abutting members are not provided with means for engaging the pipes from outside radially thereof, it is impossible to use the abutting members as separated from the mount frame. The presence of the mount frame therefore renders the device heavier, larger and more costly than otherwise.

Holders of small size are also known which are adapted to hold two adjacent nested pipes to each other. When holding a multiplicity of nested pipes, however, a large number of such holders must be used, hence costly, while they have the problem of being unfit for holding together adjacent pipes which differ greatly in diameter.

The object of the present invention is to provide a holding device for nested pipes which is simple in construction, inexpensive and capable of properly holding adjacent pipes even when the pipes differ greatly in diameter and which can be attached to nested pipes singly without using any mount frame.

To fulfill this object, the present invention provides a device for holding a plurality of nested pipes each having a socket formed with an annular groove in its inner periphery and an annular shoulder on its outer periphery, the device comprising an abutting member adapted to contact the socket ends of all the pipes, and at least one radial-axial retainer means removably mountable on the abutting member and having an engaging projection adapted to fittingly engage in the annular groove of the diametrically larger of two adjacent pipes included in the pipes and engaging stepped means adapted to engage with the annular shoulder of the diametrically smaller of the two pipes.

With the holding device of the above construction, the radial-axial retainer means cooperates with the abutting member to hold together two pipes which are greatly different in diameter, and these means and member further cooperate with socket spacers to hold other pipes in place. Since the holding device can be held by the retainer means to the nested pipes inward and also outward radially thereof, the device can be attached to the pipes singly. While the holding device can be fixed to a mount frame along with other like devices to provide a larger and heavier overall holding device, the mount frame need not always be used because of the above feature.

According to a preferred embodiment of the invention, the retainer means is removably mountable on the abutting member by screw means by which the position of the retainer means is adjustable longitudinally of the abutting member. The holding device can therefore be attached to the nested pipes as positioned accurately by adjusting the position of the retainer means. When desired, a pawl member which is fittingly engageable in the annular groove of the innermost pipe may be mounted either removably or unremovably on one end of the abutting member.

For holding nested pipes, it is of course necessary to use a plurality of such holding devices, i.e. abutting members. If the abutting members are used as attached to a mount frame, the pipes can be held together more effectively, but this entails the drawback that the overall assembly becomes large-sized and heavier. In the absence of the mount frame, on the other hand, the overall assembly is lightweight and compact but holds the pipes somewhat less stably. Thus the mount frame should be used selectively in accordance with the requirements to be fulfilled. In this sense, it should be understood that the present invention is characterized in that the abutting member can be attached, even singly, to nested pipes.

Accordingly the invention also provides a holding device of the type wherein a plurality of abutting members described above are mounted on a mount frame.

These and other features of the invention will become apparent from the embodiments to be described below with reference to the accompanying drawings, in which.

Figure 1:
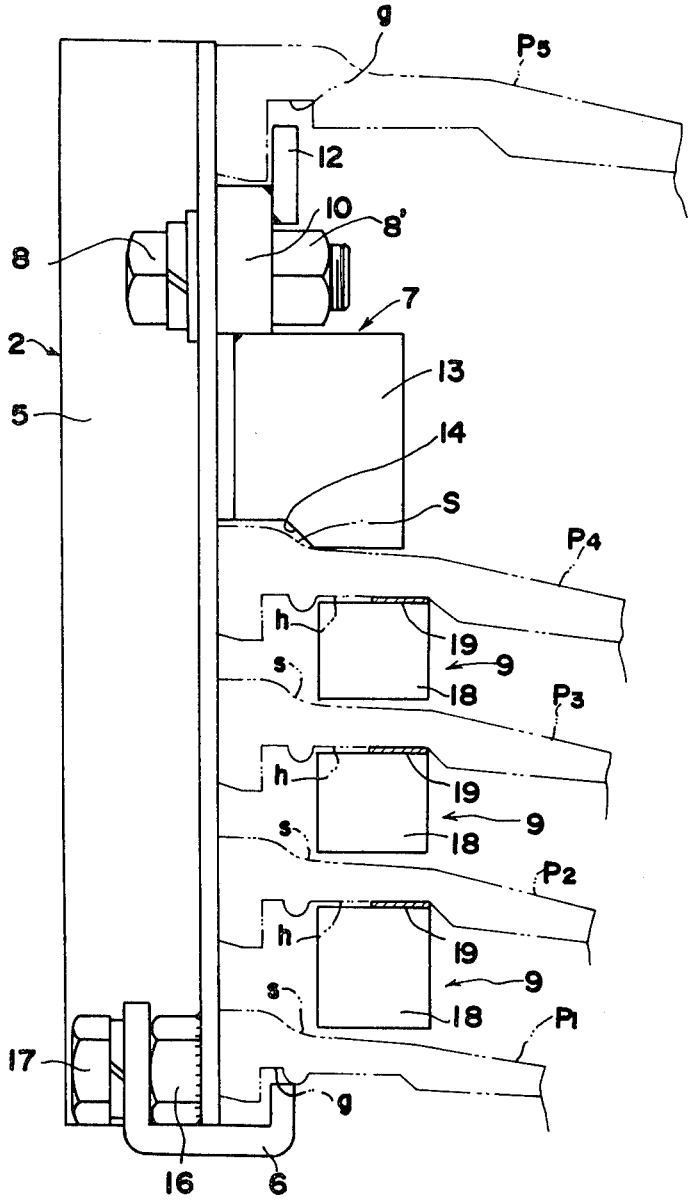
FIG. 1 is a side elevation partly in section and showing a unit holding device embodying the invention and attached to the socket ends of nested pipes.
Figure 2:
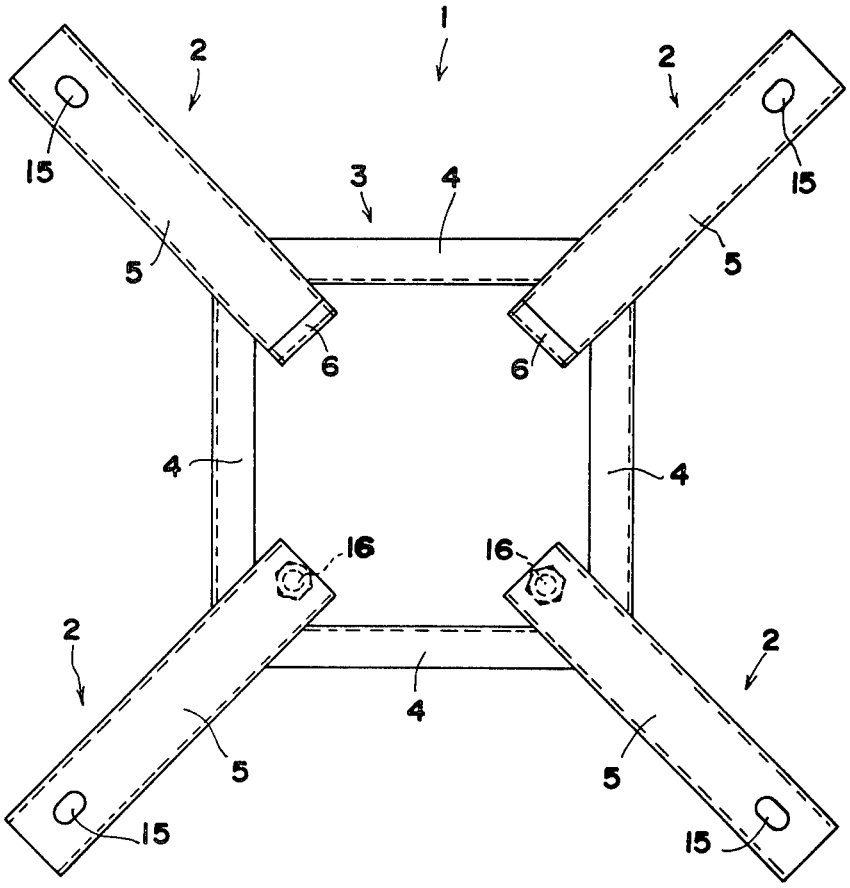
FIG. 2 is a front view showing an overall holding device comprising a plurality of unit holding devices the same as the one shown in FIG. 1 and mounted on a mount frame.

With reference to FIGS. 1 and 2, a plurality of pipes P are nested which, as arranged from inside to outside, are indicated at P1 to P5. The pipe P4 and the pipe P5 differ greatly in diameter. Each of the pipes P is formed in the inner periphery of its socket with an annular groove g and an annular recessed portion h serving as a packing seat and has an annular shoulder s on the socket outer periphery.

The pipes P1 to P5 are held to one another at their socket ends by an overall holding device 1. The device comprises a plurality of unit holding devices 2 attached, each at its one end, to the four corners of a square mount frame 3 and extending radially of the pipes P1 to P5. The mount frame 3 is made up of four bars 4 of the same length which are connected together in a square arrangement.

Each of the unit holding devices 2 comprises an abutting member 5 in the form of a channel member and bearing against the socket ends of all the pipes P1 to P5, a pawl member 6 provided on the radially inner end of the abutting member 5 with respect to the pipes and fittingly engaged in the annular groove g of the innermost pipe P1, and radial-axial retainer means 7 provided between the outermost pipe P5 and the next inner pipe P4 and removably mounted on the abutting member 5 by a bolt 8 and a nut 8'. Socket spacers 9 are interposed between the pipes P1 to P4.

Figure 3A:
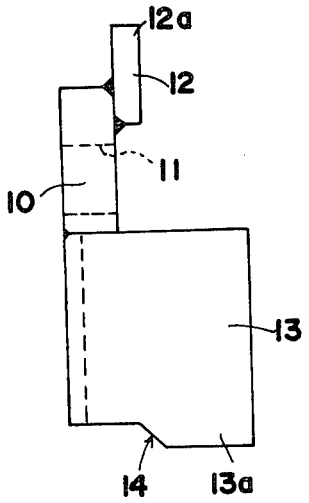
FIGS. 3*a* and 3*b* are a side elevation and a front view, respectively, showing radial-axial retainer means.
Figure 3B:
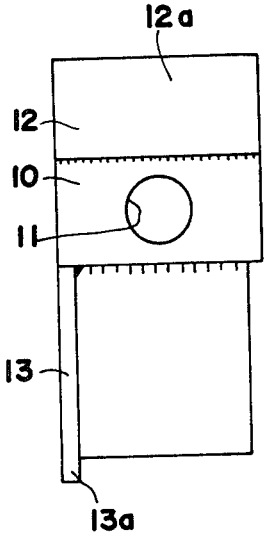

As seen in FIGS. 3*a* and 3*b*, the radial-axial retainer means 7 comprises a mount plate 10 in the form of a flat plate and having a bolt hole 11, a first engaging member 12 in the form of a flat plate and attached to the mount member 10 at the radially outer end thereof with respect to the pipes, and a second engaging member 13 in the form of an angle plate and attached to the other end of the mount member 10. The first engaging member 12 has an outer end serving as an engaging projection 12*a* fittingly engaged in the annular groove g of the outermost pipe P5. The second engaging member 13 has an engaging stepped portion 14 engaging the annular shoulder s of the pipe P4 outward axially thereof. The angle plate 13 has a wall perpendicular to the abutting member 5 and formed with a projection 13*a* on the radially inner end thereof with respect to the pipe to thereby define the engaging stepped portion 14. The mount member 10, i.e. the retainer means 7, is removably mounted on the abutting member 5 by the bolt 8 inserted through a slot 15 (FIG. 2) formed in the outer end of the abutting member 5 and through the bolt hole 11 in the mount member 10 and by the nut 8' screwed on the bolt 8. Since the bolt 8 is shiftable within the slot 15, the position of the retainer means 7 is easily adjustable.

As shown in FIG. 2, the pawl member 6 is attached to the above-mentioned inner end of each of the upper two abutting members 5. On the other hand, the pawl member 6 is removably mounted on the inner end of each of the lower two abutting members 6 by a nut 16 attached to the inner end and by a bolt 17 screwed in the nut 16. Unless some of the pawl members 6 are thus made removable, it is impossible to install the overall holding device 1 on the nested pipes P1 to P5.

Each of the socket spacers 9 comprises a plurality of blocks 18 of wood, synthetic resin, rubber or the like fixed to an annular steel band 19 as suitably spaced apart circumferentially thereof and is self-retainable in place. All the spacers 9 are mounted similarly. For example, the spacer 9 provided between the pipe P3 and the pipe P4 has its outer periphery fittingly retained in the annular recessed portion h of the pipe P4 by the resiliency of the steel band 19, with the edge at one side of its inner periphery in engagement with the annular shoulder s of the pipe P3, thereby preventing the pipe P3 from being drawn into the pipe P4 axially.

When the overall holding device 1 of the above construction is used, the pipes P1 to P5 bear against the abutting members 5 of the unit holding devices 2 and are thereby prevented from moving leftward axially thereof in FIG. 1. The pipes P1, P4 and P5 are restrained from moving axially rightward by the action of the pawl members 6 and radial-axial retainer means 7. The pipes P2 and P3 are similarly prevented from moving axially rightward by being engaged by the pipes P1, P4 and P5 which are thus restrained from moving axially rightward, by means of the spacers 9 (by the engagement of their annular shoulders with the spacers 9 opposed thereto). Furthermore, all the pipes P1 to P5 are restrained from moving both inward and outward radially thereof relative to one another by the action of the pawl members 6, spacers 9 and retainer means 7.

Although four unit holding devices 2 are fixed to the mount frame 3 to provide a single overall holding device 1 according to the embodiment described, the number of unit devices 2 can be larger or smaller than four. To render the assembly lightweight, a plurality of unit holding devices 2 may be attached to nested pipes separately without using any mount frame 3. In this case, pawl members 6 (although not always needed) can be fixedly provided on the abutting members 5.

The connected bar 4, as well as the abutting member 5, can be made from an angle plate or a channel member. The second engaging member 13 can be prepared from a channel member, with each of its side walls formed with an engaging stepped portion.

Since the pipe P4 and the pipe P5 differ greatly in diameter in the case of the illustrated embodiment, the radial-axial retainer means 7 is mounted on the abutting member 5 as positioned close to the radially outer end thereof with respect to the pipe. However, the position of the means 7 is changeable in accordance with the position of the two pipes having greatly different diameters. The number of the pipes to be nested is variable as desired; if the number is smaller, the abutting members 5 used are of course shorter.

The second engaging member 13 need not always be attached to the mount member 10 but can be removably mounted on the abutting member 5 independently of the mount member 10 and made adjustable in position. The first and second engaging members 12 and 13 are then shiftable relative to each other in accordance with a change, if any, in diameter between the pipe P4 and the pipe P5.

What is claimed is:

1. A device for holding nested pipes including at least two adjacent pipes differing greatly in diameter, each nested pipe having a socket formed with an annular groove in its inner periphery and an annular shoulder on its outer periphery, the device comprising an abutting member adapted to contact the socket end faces of all the pipes, and at least one radial-axial retainer means removably mountable on the abutting member and adapted to be positioned between said two adjacent pipes, said radial-axial retainer means comprising a mount member having a bolt hole and removably mountable on the abutting member by a bolt insertable through the bolt hole thereof and through a slot formed in the abutting member and by a nut adapted to be screwed on the bolt, a first engaging member attached to one end of the mount member close to the diametrically larger of said two adjacent pipes and provided with an engaging projection adapted to engage in the annular groove of the diametrically larger of said two adjacent pipes, and a second engaging member disposed close to the diametrically smaller of said two adjacent pipes and provided with stepped engaging means adapted to engage with the annular shoulder of the diametrically smaller of said two pipes.

2. A device as defined in claim 1 which further has a pawl member mounted or mountable on one end of the abutting member and adpated to fittingly engage in the annular groove of the innermost pipe.

3. A device as defined in claim 2 wherein the pawl member is attached to said one end of the abutting member.

4. A device as defined in claim 2 wherein the pawl member is mountable on said one end of the abutting member by a nut attached to said one end and a bolt adapted to be screwed in the nut.

5. A device as defined in claim 1 wherein the second engaging member is attached to the other end of the mount member.

6. A device as defined in claim 1 wherein each of the mount member and the first engaging member is made of a flat plate, and the second engaging member is made of an angle plate, the angle plate having a wall perpendicular to the abutting member and formed with a projection on an edge thereof remote from the mount member to thereby define an engaging stepped portion.

7. A device for holding nested pipes including at least two adjacent pipes differing greatly in diameter, each nested pipe having a socket formed with an annular groove in its inner periphery and an annular shoulder on its outer periphery, the device comprising a mount frame, a plurality of radially extending abutting members each attached at its one end to the mount frame and adapted to contact the socket end faces of all the pipes, and at least one radial-axial retainer means removably mountable on each abutting member and adapted to be positioned between said two adjacent pipes, said radial axial retainer means comprising a mount member having a bolt hole and removably mountable on the abutting member by a bolt insertable through the bolt hole thereof and through a slot formed in the abutting member and by a nut adapted to be screwed on to the bolt, a first engaging member attached to one end of the mount member close to the diametrically larger of said two adjacent pipes and provided with an engaging projection adapted to engage in the annular groove of the diametrically larger of said two adjacent pipes, and a second engaging member disposed closed to the diametrically smaller of said two adjacent pipes and provided with stepped engaging means adapted to engage with the annular shoulder of the diametrically smaller of said two pipes.

8. A device as defined in claim 7 which further has pawl members adapted to fittingly engage in the annular groove of the innermost pipe, and at least one of the pawl members is removably mountable on one of the abutting members at said one end thereof, the other pawl members being attached to the other abutting members respectively each at said one end thereof.

9. A device as defined in claim 7 wherein the mount frame is square, and four abutting members are attached each at said one end to the four corners of the mount frame respectively to extend radially.

10. A device as defined in claim 9 wherein the square mount frame comprises four connected bars.

11. A device as defined in claim 7 wherein the second engaging member of said radial-axial retainer means is attached to the other end of the mount member.

* * * * *